US007630668B2

(12) United States Patent
Abe

(10) Patent No.: US 7,630,668 B2
(45) Date of Patent: Dec. 8, 2009

(54) IMAGE FORMING APPARATUS USING SPEED REDUCTION DEVICE WITH ELASTIC BODIES

(75) Inventor: Hiroshi Abe, Kobe (JP)

(73) Assignee: Kyocera Mita Corporation, Osaka (JP)

( * ) Notice: Subject to any disclaimer, the term of this patent is extended or adjusted under 35 U.S.C. 154(b) by 362 days.

(21) Appl. No.: 11/491,822

(22) Filed: Jul. 24, 2006

(65) Prior Publication Data

US 2007/0019992 A1 Jan. 25, 2007

(30) Foreign Application Priority Data

Jul. 22, 2005 (JP) ..... 2005-212158

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS 4,723,145 A * 2/1988 Takada et al. ..... 399/36

FOREIGN PATENT DOCUMENTS

JP 2001183888 A * 7/2001
JP 2002-115751 4/2002
JP 2002-171779 6/2002

OTHER PUBLICATIONS

Translation of Imamura (JP2002-171779).*

* cited by examiner

*Primary Examiner*—David M Gray
*Assistant Examiner*—Erika J. Villaluna
(74) *Attorney, Agent, or Firm*—Ditthavong Mori & Steiner, P.C.

(57) ABSTRACT

In an image forming apparatus using a speed reduction device with elastic bodies, the rotational speed of a motor is reduced by the speed reduction device using the elastic bodies. The rotational speed of the speed reduction device is detected by an output rotation sensor, and the rotational variation components contained in the rotational speed are extracted by a high path filter. A voltage comparator determines whether the rotational variation components reach a predetermined voltage value or lower, and causes an image writing control unit to wait to write image data on a rotating drum until the rotational variation components reach the predetermined voltage value.

3 Claims, 4 Drawing Sheets

IMAGE FORMING APPARATUS USING SPEED REDUCTION DEVICE WITH ELASTIC BODIES

BACKGROUND OF THE INVENTION

1. Field of the Invention

This invention relates to image forming apparatuses using a speed reduction device with elastic bodies, and for example, relates to an image forming apparatus using a speed reduction device with elastic bodies that reduce the rotational speed of a motor, which rotates a photoreceptor drum, transfer belt and other components in a copying machine and so forth, by means of frictional contact of the elastic bodies.

2. Description of Background Art

Image forming apparatuses such as copying machines for black and white printing require only a single-color drum to be rotated, thus variations in the rotational speed of the drum are acceptable to some degree. However, color printing requires creating four different color images by rotational drums and superimposing the images. Because of this, the variations in the rotational speed of the drums to create each color image cause color registration errors and color nonuniformity. In order to prevent such a color registration error and nonuniformity, there is a need for a rotation drive device rotating photoreceptor drums, transfer belt and so forth at a relatively low speed and with high accuracy.

FIG. 5 is a cross-sectional view showing such a conventional rotation drive device. This rotation drive device is disclosed in Japanese unexamined patent publication No. 2002-115751. In FIG. 5, the rotation drive device includes a motor 1, a speed reduction device 2 and a speed detection mechanism 3. The speed reduction device 2 employs a traction system (friction transmission system), which is allegedly advantageous in reducing the rotational variations.

An end of a rotary shaft 14 in the motor 1 acts as a sun roller 20 and makes contact with a plurality of planetary rollers 22. Each planetary roller 22 is cantilevered by a rod 28 from a carrier 23. The planetary rollers 22 are in contact with an inner surface of an internal ring 21 via elastic bodies 31 such as rubber. The rotation of the rotary shaft 14 driven by the motor 1 produces a torque which is reduced by the sun roller 20, planetary rollers 22 and internal ring 21 at their reduction ratios depending on the individual external and internal diameters, and the reduced torque is then output through the carrier 23 and an output shaft 24.

The output from the speed detection mechanism 3 is input to a controller 4. Based on a control signal from the controller 4, a drive device 5 controls the rotational speed of the motor 1. Since the planetary rollers 22 used in the speed reduction device 2 make contact with the internal ring 21 via the elastic bodies 31 which may cause generation of a delay element in a feedback control loop, the controller 4 should control the drive device 5 in a manner that the drive device 5 will not be uncontrollable due to the delay element.

For this purpose, the controller 4 adopts a feedback control as disclosed in Japanese unexamined patent publication No. 2002-171779 (hereinafter referred to as "patent document"). Specifically, a rotational speed output from the speed reduction device 2 is detected to obtain a difference value from a target speed. The controller 4 feeds a speed command signal based on the difference value to the motor 1 to directly control the motor's rotational speed, therefore suppressing delay factors.

The speed reduction device 2 utilizing the frictional force of the elastic bodies 31 has another problem. In order to reduce speed by means of the frictional force, the elastic bodies 31 and planetary rollers 22 must be applied with pressure, thereby causing deformation of a pressurized part of the elastic bodies 31. During operation of the speed reduction device 2, that is to say when pressure continues to be applied successively along the circumference of the planetary roller 22, the elastic bodies 31 by deforming continuously to their original shape without partial deformation. In this case, the problem can be avoided through the control to reduce the delay factors caused by the deformation, as disclosed in the patent document.

However, once the speed reduction device 2 is stopped, only some parts of the elastic bodies 31 stay under pressure and then become deformed. The elastic bodies 31 that are applied with the pressure for a shorter time take a shorter time to be restored, while the elastic bodies 31 that are applied with the pressure for a longer time take a longer time to be restored. Thus, in the case where the speed reduction device 2 is stopped and then rotated again, during the interval until the deformed parts return to their original shape, the rotational speed fluctuates every time the deformed parts transmit drive. Depending on the structure, the rotational speed fluctuates every time the elements of the speed reduction device 2 come to a halt position.

The time of the rotation variations caused by the deformed part of the elastic bodies 31 caused by the halt is usually much shorter than a response frequency of the feedback control. Because of this, if the feedback control system disclosed in the patent document is used to detect the deformed parts of the elastic bodies 31 produced during the halt in order to exercise the feedback control, an excessive control will occur when the speed reduction device 2 is continuously driven under the feedback control. Therefore, the feedback control utilizing the deformed part of the elastic bodies 31 caused by the halt is not effective.

The rotation variations of the speed reduction device 2, which is used to drive the photoreceptor drum or transfer belt in the image forming apparatus, generated during image formation provide a fatal effect on the formed image. In a color copying machine, for example, a color registration error may occur simultaneously with the speed variations.

When the speed reduction device 2 with the elastic bodies 31 used in the rotation drive device is activated again after a halt, the rotation variations occur due to the partial deformation of the elastic bodies 31 caused by the halt, which is an unavoidable problem that cannot be solved by the usual feedback control. However, the rotational variations generated during the image formation cause image degradation, and therefore must be avoided.

The elastic bodies 31 that are deformed within their deformable limit can return to their original shape over time after eliminating factors responsible for the deformation. This means that the rotational variations will disappear after a predetermined lapse of time required for the speed reduction device 2 to restore to its original shape. In the case where the speed reduction device 2 stops for a long time and the elastic bodies 31 are possibly deformed, the rotational variations during the image formation can be avoided by letting the image formation wait until the deformation of the elastic bodies 31 are restored after the resumption of rotation.

The recovery time of the deformed part would vary depending on the type of the elastic bodies 31 in use, pressure applied to the elastic bodies 31 and other conditions such as temperature and humidity. Therefore, variations of the individual speed reduction device 2, usage environment and so forth must be considered all together in order to determine the actual length of standby time. However, the rotational variations may not occur depending on the individual difference of the speed reduction device 2 and the usage environment, because the elastic bodies 31 may have been restored before the above-determined standby time elapses. In this case, the processing capacity for image formation will be decreased by the wasted standby time.

SUMMARY OF THE INVENTION

It is an object of the present invention to provide an image forming apparatus using a speed reduction device with elastic bodies capable of preventing degradation of the processing capacity.

The image forming apparatus according to the invention has a speed reduction device with elastic bodies that reduce the rotational speed of a motor. The image forming apparatus comprises a rotational speed detection unit for detecting the rotational speed reduced by the speed reduction device with the elastic bodies, a rotational variation detection unit for detecting the rotational variations caused by deformation of the elastic bodies based on the detection output from the rotational speed detection unit, an image forming unit for forming images, a standby control unit for causing the image forming unit to wait to form images until the rotational variations detected by the rotational variation detection unit reach a predetermined value or lower.

Since the image forming apparatus is configured so as to detect the rotational speed reduced by the speed reduction device with the elastic bodies, to detect the rotational variations caused by the elastic bodies based on the detection output, and wait image forming by the image formation unit until the detected rotational variations reach the predetermined value or lower, the image forming apparatus does not need to wait until the rotational variations are completely eliminated. Therefore, it is possible to eliminate extending the standby time, and to prevent the degradation of the processing capacity for forming images.

As a result, it is possible to provide the image forming apparatus using the speed reduction device with the elastic bodies capable of preventing the degradation of the processing capacity.

Specifically, the standby control unit includes a voltage comparison unit for comparing a voltage corresponding to the rotational variations detected by the rotational variation detection unit and a previously set voltage and causing the image forming unit to wait to form images until the differential voltage reaches a predetermined voltage value or lower.

More preferably, the image forming unit includes a rotating drum for forming image data, an image writing control unit for writing the image data on the rotating drum. The voltage comparison unit causes the image writing control unit to wait to write the image data on the rotating drum until the differential voltage reaches the predetermined voltage value or lower.

Further, the image forming apparatus includes an abnormality determination unit for determining that the speed reduction device with the elastic bodies is abnormal when the rotational variations detected by the rotational variation detection unit have not reached the predetermined value or lower after the previously set time elapsed.

DESCRIPTION OF PREFERRED EMBODIMENT

Figure 1:
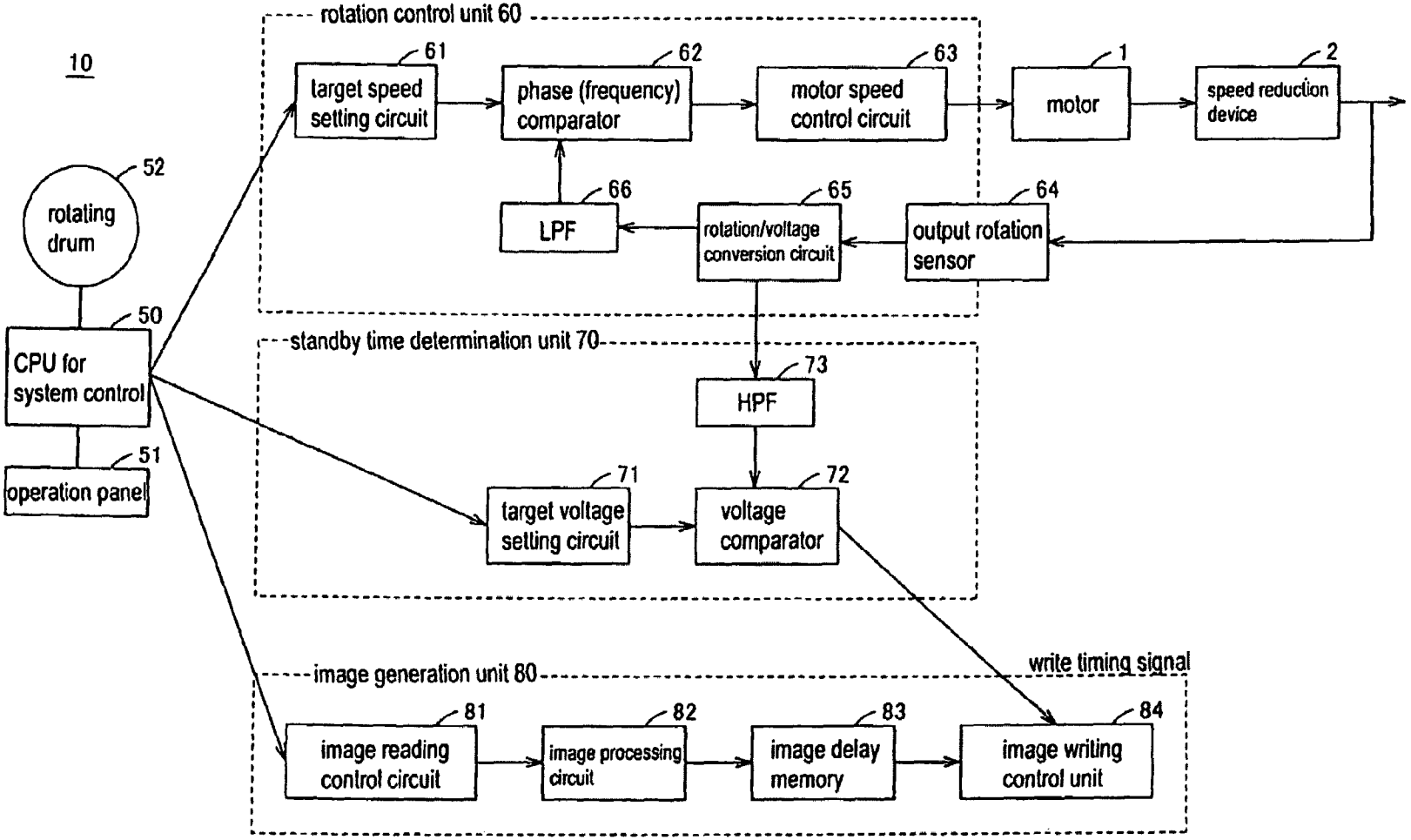
FIG. 1 is a block diagram illustrating an image forming apparatus using a speed reduction device with elastic bodies according to an embodiment of the present invention.
Figure 5:
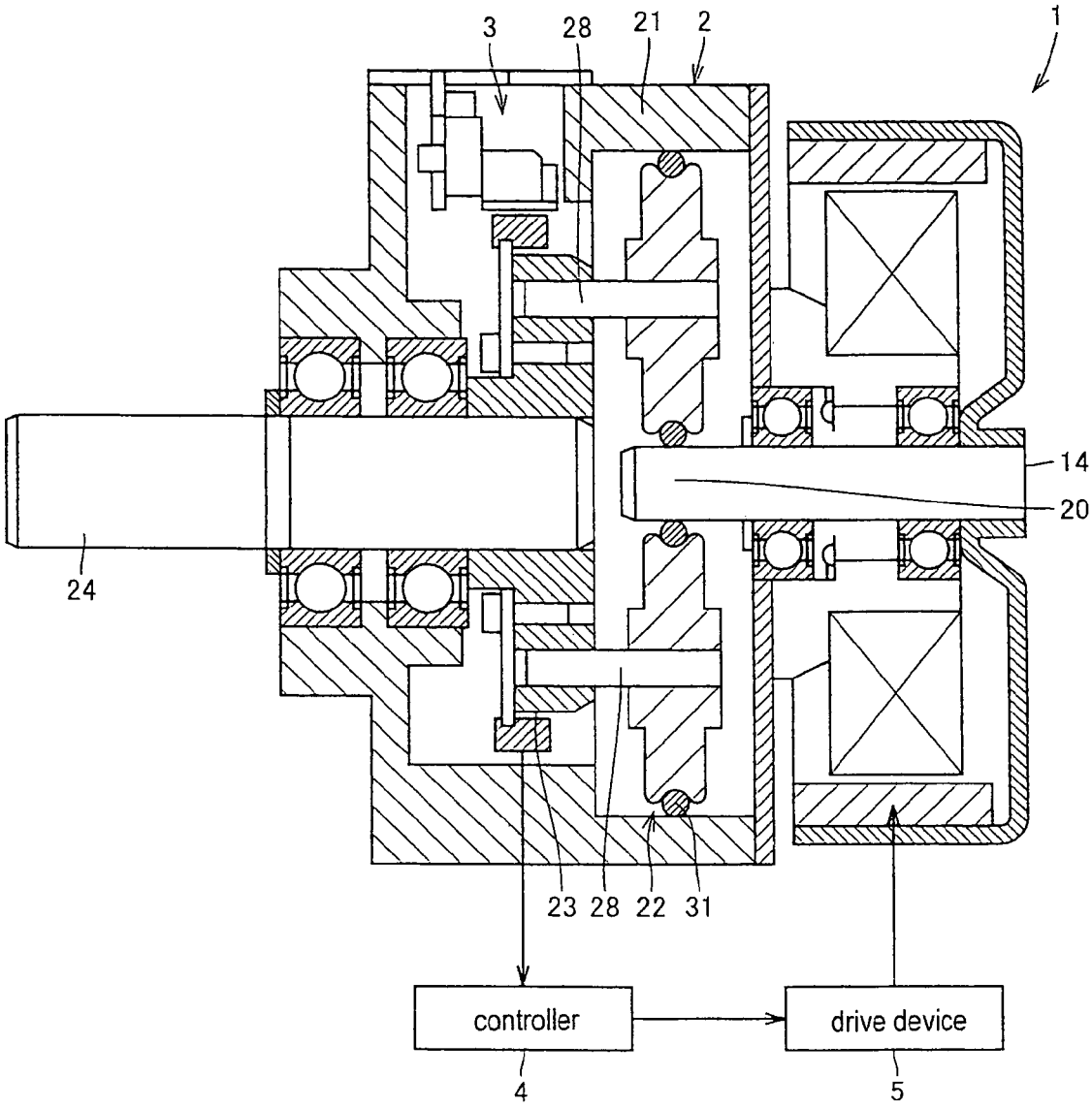
Fig. 5 Prior Art
FIG. 5 is a cross-sectional view illustrating a conventional rotation drive device.

FIG. 1 is a block diagram illustrating an image forming apparatus using a speed reduction device with elastic bodies according to an embodiment of the present invention. The speed reduction device with the elastic bodies in this embodiment is identical to the conventional speed reduction device shown in FIG. 5.

An image forming apparatus 10 includes a CPU for system control 50, an operation panel 51, a rotation control unit 60, a standby time determination unit 70, an image generation unit 80 and a rotating drum 52. The CPU for system control 50 is adapted to control the entire image forming apparatus 10 and connected to the operation panel 51. Operation of a copy key (not shown) provided on the operation panel 51 initiates copying action.

The rotation control unit 60 is adapted to control the motor 1 in a manner that the motor rotates at a target speed. A voltage signal with a frequency corresponding to the target speed is given from the CPU for system control 50 via a target speed setting circuit 61 to a phase (frequency) comparator 62. The phase (frequency) comparator 62 compares phases (frequencies) of the voltage signal with the frequency corresponding to the target speed and a voltage signal, which is an output of an LPF (low pass filter) 66, corresponding to the rotational number output from the speed reduction device 2 shown in FIG. 5, and feeds the output signal to a motor speed control circuit 63.

The motor speed control circuit 63 controls the output speed of the motor 1 based on the output from the phase (frequency) comparator 62. The torque of the motor 1 is transmitted to the speed reduction device 2 as described in FIG. 5. The output rotational speed from the speed reduction device 2 is detected by an output rotation sensor 64 functioning as a rotational speed detection unit, and the detected output rotational speed is fed to a rotation/voltage conversion circuit 65, which in turn converts the output rotational speed into a voltage signal. This output rotation sensor 64 is included in the speed detection mechanism 3.

The converted voltage signal is now given to the LPF 66, which removes high frequency components contained in the voltage signal. The high frequency components correspond to the rotational speed variations produced when the elastic bodies 31 with the deformed part caused by the halt of the speed reduction device 2 restores to their original shape by a restart of the motor 1. The phase (frequency) comparator 62, rotation/voltage conversion circuit 65 and LPF 66 constitute a feedback control circuit in this embodiment, however, the present invention may also be configured so as to constitute a feedforward control circuit.

In addition, the high frequency components corresponding to the rotational variations caused by the deformation of the elastic bodies 31 during the halt of the speed reduction device 2 are extracted by an HPF (high pass filter) 73, functioning as a rotational variation detection unit, in the standby time determination unit 70 and then fed to a voltage comparator 72 functioning as a voltage comparison unit. In a target voltage setting circuit 71 a target voltage value is set, which is used by the CPU for system control 50 to determine that the rotational variations are not generated. The target voltage and the voltage with the high frequency components extracted by the HPF 73 are compared by the voltage comparator 72. Thus, the target voltage setting circuit 71 and voltage comparator 72 function as a standby control unit.

The image generation unit 80 includes an image reading control circuit 81, an image processing circuit 82, an image delay memory 83 and an image writing control unit 84. The image reading control circuit 81, which is controlled by the CPU for system control 50, reads an original document by using a reading element such as a CCD and gives the read image signal to the image processing circuit 82. The image delay memory 83 delays the image signal and feeds the delayed image signal to the image writing control unit 84.

The image writing control unit 84 writes image data on a rotating drum 52 based on a write timing signal given from the voltage comparator 72. The image data written on the rotating drum 52 is printed by a printing unit (not shown). The image writing control unit 84 and rotating drum 52 constitute an image forming unit.

Figure 2:
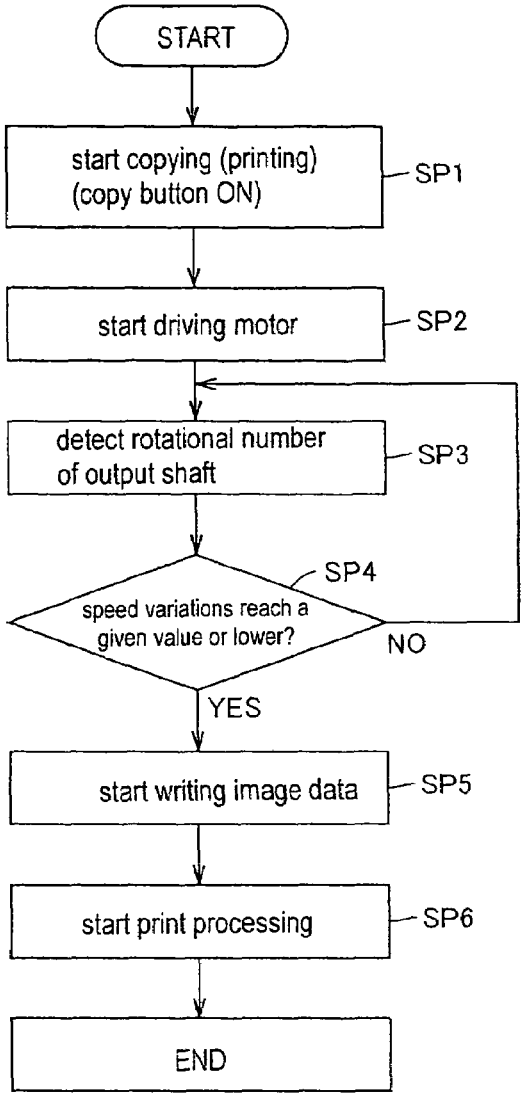
FIG. 2 is a flow chart describing the operation of the image forming apparatus using the speed reduction device with the elastic bodies according to one embodiment of the present invention.

FIG. 2 is a flow chart describing the operation of the image forming apparatus using the speed reduction device with the elastic bodies according to the embodiment of the present invention.

With the operation of the copy button on the operation panel 51, the CPU for system control 50 determines that the copying process has begun in Step (SP for short in FIG. 2) SP 1 shown in FIG. 2. In Step SP2, when the CPU for system control 50 sets a target speed in the target speed setting circuit 61, a voltage corresponding to the target speed is given to the phase (frequency) comparator 62. Based on the voltage given from the phase (frequency) comparator 62, the motor speed control circuit 63 begins to drive the motor 1.

The rotational number of the motor 1 is reduced by the speed reduction device 2, and the output rotational speed is detected by the output rotation sensor 64 in Step SP 3. The rotational speed output from the output rotation sensor 64 is converted by the rotation/voltage conversion circuit 65 into a voltage which is then given through the LPF 66 to the phase (frequency) comparator 62. The phase (frequency) comparator 62 compares this voltage with the voltage set in the target speed setting circuit 61, and the motor 1 is feedback-controlled so as to rotate at the target speed.

Figure 3:
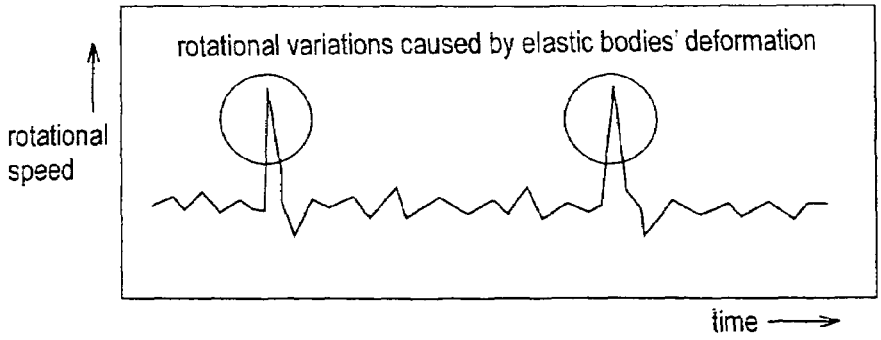
FIG. 3 illustrates that the detected rotational speed contains high frequency components associated with the rotational variations.

FIG. 3 illustrates that the rotational speed detected by the output rotation sensor 64 contains high frequency components associated with the rotational variations.

When the speed reduction device 2 stops, the elastic bodies 31 become deformed. Because of this, when the speed reduction device 2 is started again, the rotational speed fluctuates since the deformation of the elastic bodies 31 is not restored immediately. Therefore, the output from the output rotation sensor 64 contains high frequency components associated with the speed variations as shown in FIG. 3. Since the high frequency components are removed by the LPF 66 in the rotation control unit 60, the feedback control over the motor 1 can be performed irrespective of the speed variations.

In the standby time determination unit 70, the HPF 73 extracts high frequency components associated with the rotational variations. In Step SP 4, the voltage comparator 72 compares the target voltage, which is set in the target voltage setting circuit 71 and corresponds to the value to be assumed without rotation variations, with the voltage based on the high frequency components, which are extracted by the HPF 73 in order to determine whether the speed variations reach the range from approximately 2% to 3% or lower which corresponds to the level that a color registration error on the color image cannot be observed by the naked eye. The voltage comparator 72 continues comparing the target voltage and the voltage with the high frequency components until the speed variations reach a given value or lower.

In the image generation unit 80, the image reading control circuit 81 reads the image, the image processing circuit 82 processes the read image signal, and the image delay memory 83 delays the signal and feeds the image data to the image writing control unit 84. The image writing control unit 84 writes the image data on a rotating drum 52 according to a write timing signal fed by the voltage comparator 72. However, since the timing signal is not output until the speed variations are reduced to the given value or lower, in this case, the image writing control unit 84 halts writing the image data on the rotating drum 52 and holds its image forming operation.

When determining that the speed variations reach the given value or lower in Step SP 4, the voltage comparator 72 outputs the write timing signal. In Step SP 5, the image writing control unit 84 initiates writing the image data on the rotating drum 52 according to the write timing signal to form an image. Print processing by the printing unit (not shown) is performed in Step SP 6 and completes the series of processes.

As described above, the image forming apparatus according to this embodiment is configured to detect the variations in the rotational speed of the speed reduction device 2 and wait to write the image data on the rotating drum 52 until the speed variations reach a given value, thereby preventing the image to be formed from having critical defects caused by the rotational variations. For example, a color registration error generated upon variation of the speed can be prevented in a color copying machine.

The image forming apparatus is configured to write the image data on the rotating drum 52 when the speed variations are reduced to a given value or lower. Because of this configuration, in the case of a little deformation of the elastic bodies, the image forming apparatus just waits for only a short time until the elastic bodies are restored after the resumption of rotation, thereby preventing the image processing from degrading the efficiency of the image formation.

It is possible that the time in which the deformed elastic bodies are restored after the resumption of rotation may change depending on the type of the elastic bodies in use, the applied pressure and other conditions such as temperature and humidity. In this embodiment, since the image forming process does not start based on a set time required for the elastic bodies in the deformed state to return to their original state, but starts when the speed variations reach a given value or lower, unnecessary standby time can be eliminated.

Further, the image forming apparatus in this embodiment is configured to bring the image forming process into the standby state when the speed variations reach a given value or higher. Because of this configuration, even if the speed variations increase with a great deformation of the elastic bodies due to repeated use over the years, the image forming process can be brought into the standby state.

Figure 4:
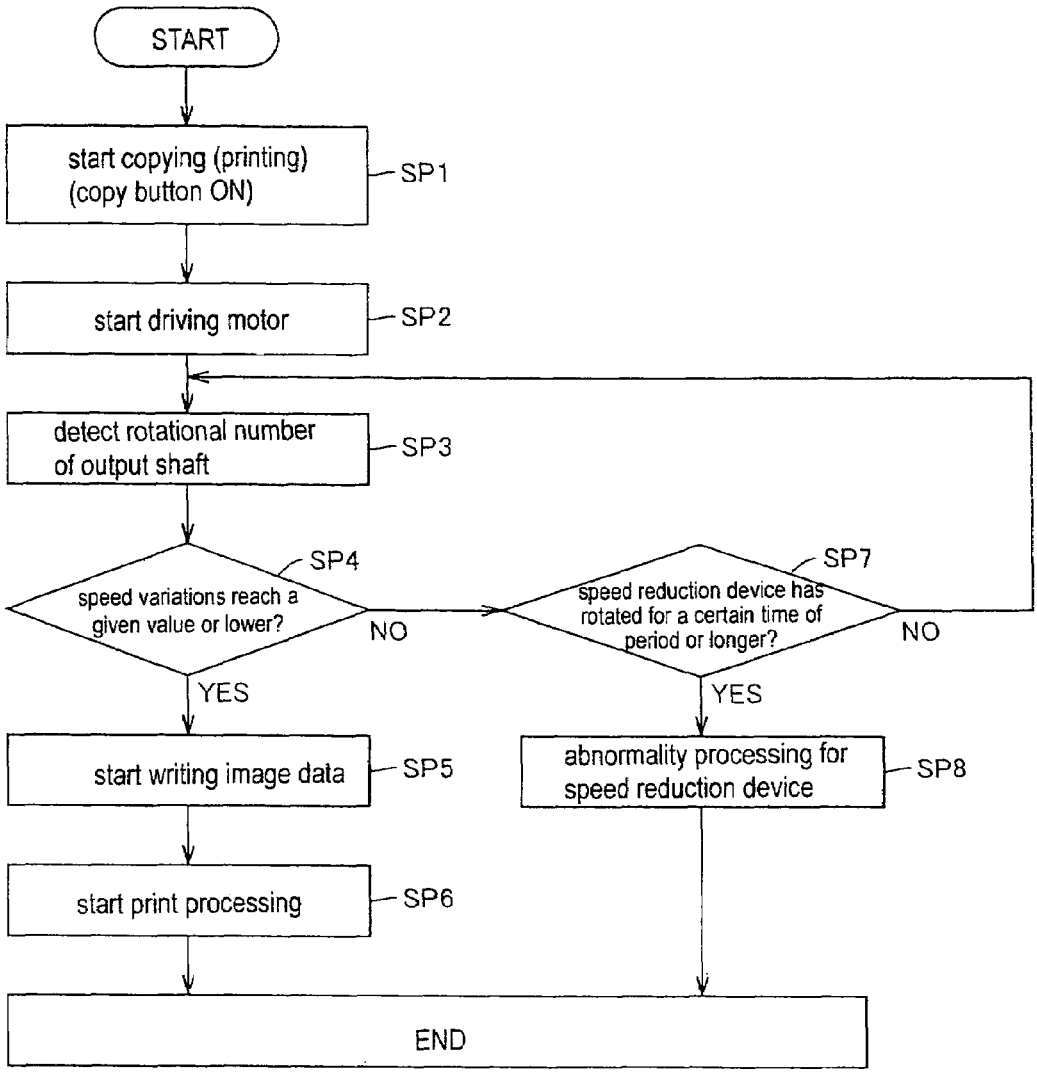
FIG. 4 is a flow chart describing the operation of an image forming apparatus using a speed reduction device with elastic bodies according to another embodiment of the present invention.

FIG. 4 is a flow chart describing the operation of an image forming apparatus using a speed reduction device with elastic bodies according to another embodiment of the present invention. In this example, the image forming apparatus is configured to detect the abnormal actions of the speed reduction device 2. FIG. 4 illustrates the processes in Steps SP 1 to SP 6, which are identical to those in FIG. 3, and newly added processes in Steps SP 7 and SP 8.

If the determination that the speed variations do not reach a given value or lower has been made in Step SP 4 as with the description for FIG. 2, it is determined whether the speed reduction device 2 rotates for a certain period of time or longer in Step SP 7. This determination can be made by the CPU for system control 50 detecting the detection output from the output rotation sensor 64 and the output from the voltage comparator 72.

If the speed reduction device 2 has not rotated for a certain period of time or longer yet, the process returns to Step SP 3 to go through the same processes shown in FIG. 2. If the speed reduction device 2 has rotated for a certain period of time or longer already, an abnormal process is performed to treat the abnormality of the speed reduction device 2 in Step SP 8. Possible abnormal processes may involve a stop of the motor 1, write-protection of the rotating drum 52 by the image writing control unit 84 and so forth. Thus, the CPU for system control 50 now functions as an abnormality determination unit.

As described above, the image forming apparatus according to this embodiment, in the same manner as the embodiment illustrated in FIG. 2, is configured not only to terminate the image formation process until the speed variations of the speed reduction device 2 reach a given value, but also to deactivate the speed reduction device 2 when the speed reduction device 2 is determined to be abnormal by detecting that the speed variations take long time to reach the given value or lower, thereby protecting the image forming apparatus 10.

The foregoing has described the embodiment of the present invention by referring to the drawings. However the invention should not be limited to the illustrated embodiment. It should be appreciated that various modifications and changes can be made to the illustrated embodiment within the scope of the appended claims and their equivalents.

What is claimed is:

1. An image forming apparatus having a speed reduction device with elastic bodies for reducing rotational speed of a motor by means of frictional contact of the elastic bodies, the image forming apparatus comprising:

a rotational speed detection unit for detecting the rotational speed reduced by the speed reduction device;

a rotational variation detection unit for detecting rotational variations caused by the deformation of the elastic bodies based on the detection output from the rotational speed detection unit;

an image forming unit for forming images;

a standby control unit for causing the image forming unit to wait to form the images until the rotational variations detected by the rotational variation detection unit reach a predetermined value or lower; and an abnormality determination unit for determining the abnormality of the speed reduction device with the elastic bodies when the rotational variations detected by the rotational variation detection unit have not reached the predetermined value or lower even after a previously set time elapsed.

2. The image forming apparatus according to claim 1, wherein the standby control unit includes a voltage comparison unit for comparing a voltage corresponding to the rotational variations detected by the rotational variation detection unit with a previously set voltage and causing the image forming unit to wait to form the images until the differential voltage reaches a predetermined voltage value or lower.

3. The image forming apparatus according to claim 2, wherein the image forming unit includes:

a rotating drum for forming image data; and an image writing control unit for writing the image data on the rotating drum, and the voltage comparison unit causes the image writing control unit to wait to write the image data on the rotating drum until the differential voltage reaches a predetermined voltage value or lower.

* * * * *